US005141138A

United States Patent [19]

Odet et al.

[11] Patent Number: 5,141,138

[45] Date of Patent: Aug. 25, 1992

[54] SYNTHETIC-RESIN POURING CAP WITH HINGED COVER

[75] Inventors: Philippe Odet, Chasselay; Jacques Ambrosi, Villefranche sur Saone, both of France

[73] Assignee: Astra Plastique, Saint Georges de Reneins, France

[21] Appl. No.: 551,515

[22] Filed: Jul. 11, 1990

[51] Int. Cl.[5] ..... B65D 47/00

[52] U.S. Cl. ..... 222/541; 222/547; 222/556; 222/109; 215/254

[58] Field of Search ..... 222/109, 111, 541, 547, 222/564, 556, 571; 215/253, 254; 220/259, 337, 339

[56] References Cited

U.S. PATENT DOCUMENTS

| | | | |
|---|---|---|---|
| 3,059,816 | 10/1962 | Goldstein | 222/109 |
| 3,341,046 | 9/1967 | Bereziat et al. | 215/307 |
| 4,170,315 | 10/1979 | Dubach et al. | 220/339 |
| 4,193,519 | 3/1980 | Dubach et al. | 272/547 |
| 4,244,495 | 1/1981 | Lorscheid et al. | 220/339 |

FOREIGN PATENT DOCUMENTS

| | | | |
|---|---|---|---|
| 251123 | 1/1988 | European Pat. Off. | 222/541 |
| 2600631 | 12/1987 | France | 222/541 |

*Primary Examiner*—Gregory L. Huson
*Attorney, Agent, or Firm*—Herbert Dubno; Andrew Wilford

[57] ABSTRACT

A pouring cap for mounting atop a neck of a container is unitarily formed of a synthetic resin with a body adapted to fit over the neck of the container and having an outer body edge centered on an axis, a central pour tube within the edge and forming an axially throughgoing outflow passage, and a cover sealingly engageable in a closed position with the body over the passage at the edge. A hinge is provided on the edge between the body and the cover and a hook projects axially from the cover in the closed position past the edge of the body at a location on the edge generally diametrically opposite the hinge. A retaining element defines with the body an opening adjacent the edge opposite the hinge location. The hook is engageable with elastic deformation through the opening to catch underneath the retaining element and once inserted through the opening is engaged such that the hook or the element must be permanently deformed to move the cover from the closed position. Thus the hook and element retain the cover in the closed position until the element is stripped from the body. Frangible connecting webs flanking the opening connect the retaining element to the body.

11 Claims, 4 Drawing Sheets

FIG.1
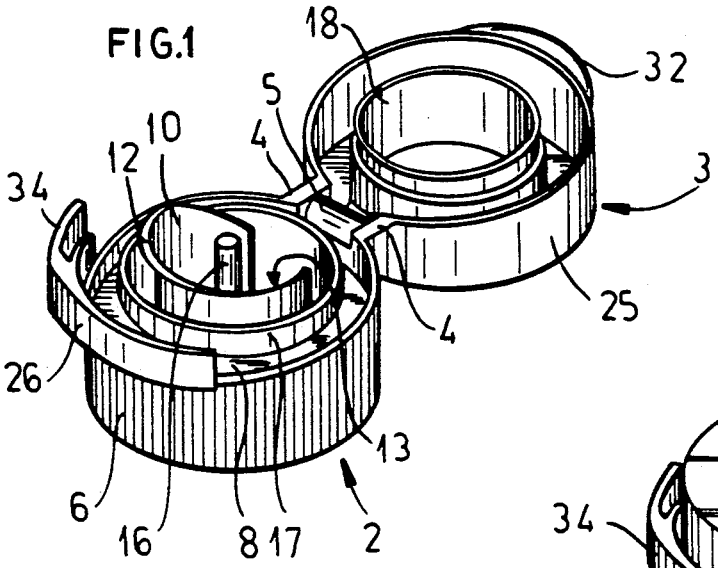
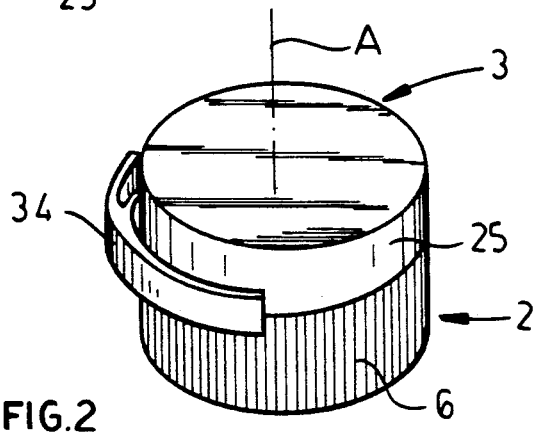
FIG.2
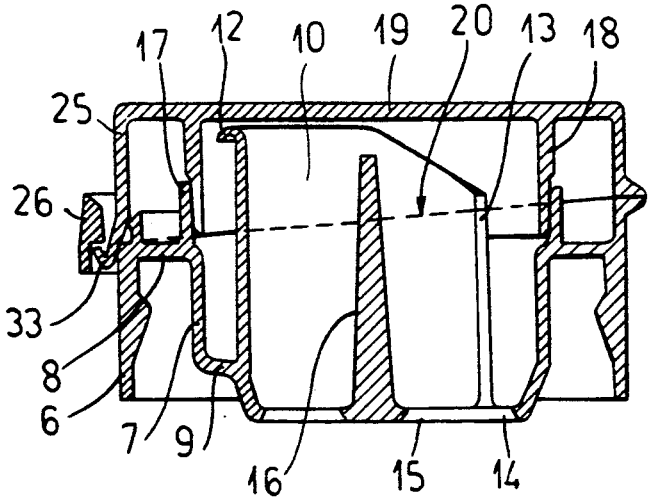
FIG.3

SYNTHETIC-RESIN POURING CAP WITH HINGED COVER

FIELD OF THE INVENTION

The present invention relates to a synthetic-resin pouring cap with a hinged cover.

BACKGROUND OF THE INVENTION

It is known to provide containers of foodstuff liquids or pharmaceutical liquids, in particular those that are thick, with pouring caps serving to provide a regular outflow of the product while avoiding that at the end of the operation drops of the product run down the container so as to make it unclean for handling.

To this end the pouring caps of housekeeping products, in particular liquid detergents, have a recessed rim inside the neck of the container having a lower extremity that is attached by an annular collar to a central flow tube for the liquid. When the container is set on a horizontal support the annular collar is inclined with respect to the horizontal toward its low point which is opposite the side of flow of liquid in the tube, this low point forming a passageway communicating between the annular space between the rim and the flow tube on one side and the interior of the container on the other side. This annular space allows collected liquid to run from the outside of the tube toward the inside of the container. A longitudinal slot formed in the tube opposite the flow side for the liquid communicates with the orifice formed in the collar so as to favor entry of air into the container as liquid runs out so as to ensure regular outflow. Such pouring caps have screw-on or snap-on covers.

There are also pouring caps having a body forming the pourer which is mounted permanently on the neck of the container, this body being equipped with a closing cover that is molded with it and to which it is attached by tabs some of which serve as hinges and others of which serve below a certain angle for the elastic return of the cover to the closed position. Such an arrangement has the advantage that it avoids any risk of losing the cover since same remains connected to the body of the cap and also allows the cap to be operated by the same hand that holds the container.

This type of cap cannot have a tamper ring like caps with a screw-on cover. Tamper-proofing can thus only be effected by an element fixed in the cap and blocking the flow passage before its first use. This solution has the disadvantage that it does not allow the end user to determine immediately if the container has been opened or not since it is necessary to remove the cap to find out.

OBJECT OF THE INVENTION

The present invention is aimed at avoiding these disadvantages by providing a synthetic-resin pouring cap having a cover hinged on the body of the cap and equipped with tamper-indicating means provided on the outside of the cap.

SUMMARY OF THE INVENTION

To this end this pouring cap of the type having a body forming a pourer fixed on the neck of a container, attached by at least one tab forming a hinge to a cover, is characterized in that the outer edge of the body is provided in its region diametrically opposed to the region of its attachment with the cover with an element forming a grip having ends that are frangibly connected with the body and a central part defining an opening with the body, and in that the cover has in its region diametrically opposite its region of attachment with the body an element projecting toward the outside and from which projects a part formed as a hook of a length at most equal to that of the opening of the grip formed on the body whose opening is turned toward the top of the cover, the dimension of the hook and the width of the grip being such that in the closed position of the cover the free end of the hook fits underneath the grip element unitary with the body.

When the cap is first closed the hook part of the cover flattens as it penetrates into the opening of the grip then expands once it passes through, the free end of the hook engaging over the grip element. In order to first open the cap it is necessary to rip or break the grip element which is made possible by frangible connecting webs. This operation frees the hook of the cover and frees action of same.

In accordance with one embodiment the grip element is formed by a ring segment centered on a point offset from the center of the cap.

According to another feature of the invention the grip element has as seen in transverse section two axially offset parts of which the lower part which is closer to the base of the cap is thinner than the upper part and forms with same a surface which is located at the opening of the grip and is perpendicular to the axis of the cap.

It is this surface that forms an abutment for the free end of the hook of the cover when any attempt is made to raise the cover before removal of the grip. The lower part of this element forms a lateral guard for the hook that cannot therefore be incorrectly manipulated to slip it out from under the grip.

Preferably the surface perpendicular to the axis of the cap and connecting the two parts of the grip element is located level with the plane of the joint of the cap. This allows the formation of large support surface for retaining the hook without complicating the structure of the mold.

In accordance with an embodiment of the cap the axis of the hinge between the body and the cover is offset axially with respect to a support plane of the body of the neck of the container, the plane of the joint of the cap passing through the region of the body equipped with the grip and the region of the cover provided with the hook being inclined with respect to a plane perpendicular to the axis of the cap. The incline angle which can be about 5° gives the assembly a particularly nice appearance by giving the cap a variable height.

When the cap is provided with a central tube for directing the outflow of liquid, the body of the cap has projecting upward from its part resting against the neck of the container a rim against which a complementary rim unitary with the cover can engage in a tight seal, the body of the cap having on the side of the grip element a lip directed upward and provided with means for latching constituted as hooks or recesses complementary to means for latching formed on the cover.

When the grip element forming a tamperproof tongue has been removed the hook can advantageously be used due to its closeness to the latching means to open the cover.

The grip element can also be attached at each of its ends to the body of the cap by a tearable web of material or by grooved connectors, this element can be extended by a tear tongue that can be pulled back to tear the connecting zones by tipping back.

BRIEF DESCRIPTION OF THE DRAWING

In any case the invention will be well understood with the said of the description that follows, reference being made to the schematic attached drawing showing by way of nonlimiting example an embodiment of this pouring cap.

FIG. 1 is a perspective view in the open position before the first closing;

FIG. 2 is a perspective view in the closed position;

FIG. 3 is a longitudinal section in the closed position;

SPECIFIC DESCRIPTION

Figure 4:
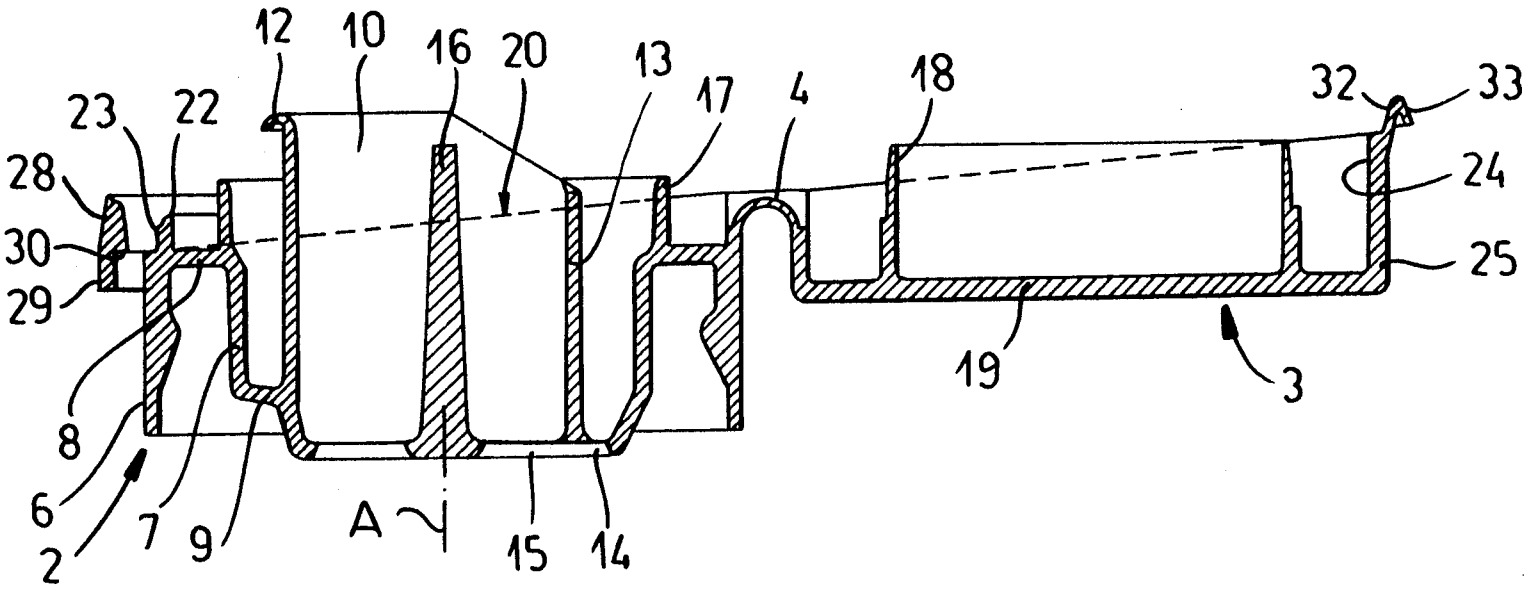
FIGS. 4 and 5 are two views, respectively in longitudinal section and from above, before the first closing.
Figure 5:
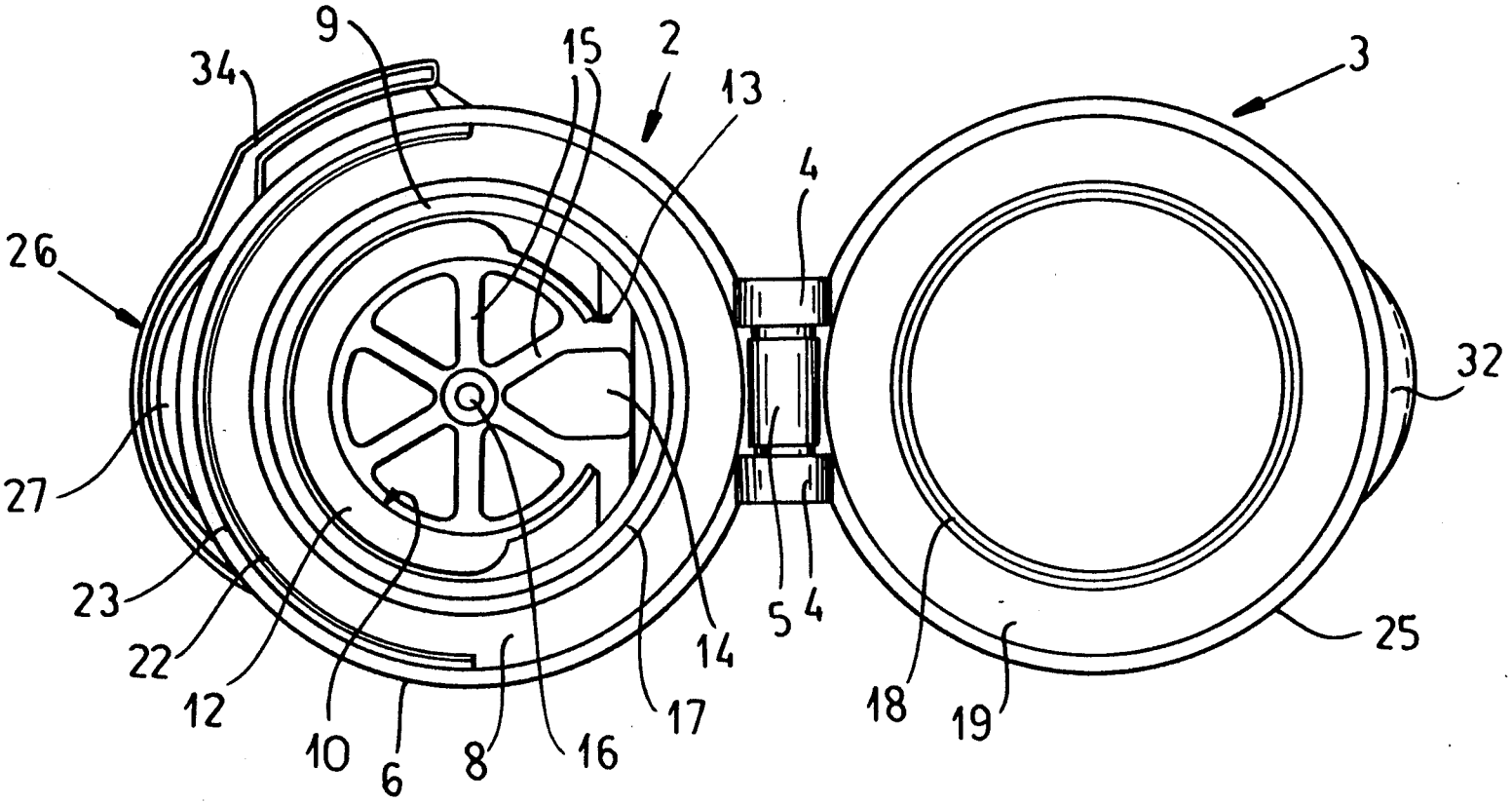

The cap shown in the drawing has a body 2 destined to be fixed on the neck of a container and a cover 3 attached to the body 2 by two tabs 4 forming hinges and provided to opposite side of a central tab 5 serving for elastic return.

The body 2 of the cap has two concentric rims 6 and 7 intended to rest on the outside and on the inside, respectively, of the neck of a container and connected to each other by an annular web 8 sitting on the edge of the neck of the container.

The inside rim 7 is connected at its lower end by an annular collar 9 to a central tube 10 serving for outflow of the liquid. This central tube 10 has level with its front edge a small spout 12 facilitating pouring of the liquid. The part of the tube 10 opposite the spout 12 has along its entire length a slot 13 which allows the center of the tube to communicate with an orifice 14 formed in the base of the annular collar 9 at the lowest point of same.

At its lower end, the tube 10 is provided with several crosspieces 15 supporting a central finger 16 that improves the regularity of flow of the liquid.

As a result with this structure, during outflow of liquid, air is taken in through the orifice 14 which ensures after use return to the inside of the container of any liquid eventually caught in the annular space whose base is formed by the collar 9.

A cylindrical rim 17 projects upward from the annular web 8, which rim 17 forms a tight seal with a complementary rim 18 that projects from a base 19 of the cover 3.

As seen in FIG. 4 the hinge 4 between the cover 3 and the body 2 is offset axially relative to the region where the body of the cap rests on the neck of the container so that it is advantageous to form this cap by means of a mold having a joint plane 20 inclined by several degrees, for example 5°, to a plane perpendicular to the axis A of the cap.

The closing means of the cap are formed by a lip 22 that projects upward and that is formed on the body 2 in the region of same opposite the hinge 4, this lip 22 having projections 23 that can cooperate with complementary recesses 24 formed in an outer rim 25 of the cover 3.

In accordance with an essential feature of the invention the outer edge of the body 2 is formed in its region diametrically opposite the region where it is connected with the lid with an element 26 forming a grip whose ends are frangibly connected with the body 2 and whose central part forms with same an opening 27.

This element 26 is formed as an annular segment and has an upper part 28 thicker than its lower part 29, the two parts 28 and 29 being interconnected at a surface 30 that is perpendicular to the axis A of the cap, located on the plane 20 of the joint of same, and directed toward the body of the cap.

The cover 3 has for its part in its region diametrically opposite the hinge 4 an element 32 that projects outward and from which projects a part 33 formed like a hook, of a length at most equal to that of the opening 27 of the grip 26 formed on the body 1, and open toward the top of the cover.

The dimensions of the slot 27 and of the hook 33 are such that the hook 33 must deform when it is pushed into the opening 27, the free end of the hook 33 being able, after fitting into the opening and under the action of the elasticity of the material, which is for example polypropylene, to catch underneath the surface 30 of the element 26.

As seen in FIG. 3 once the cap is closed the latching means of same ensures that the end of the hook 33 is maintained underneath the surface 30.

In the embodiment shown in the drawing, the element 26 is extended by a tear tongue 34.

Figure 6:
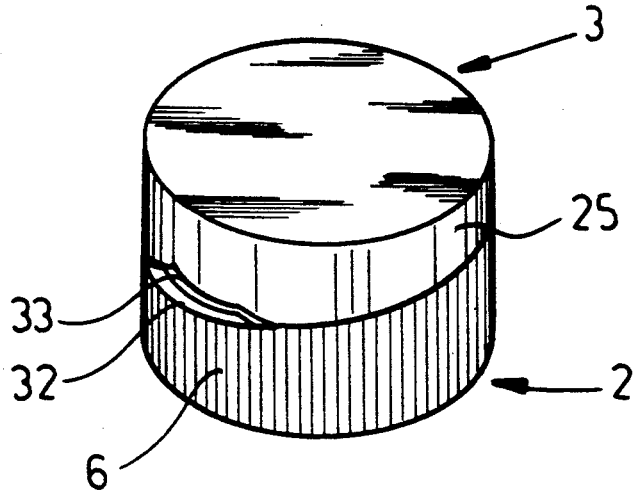
FIGS. 6 and 7 are two views, respectively in perspective and in longitudinal section, after tearing of the tamper element.
Figure 7:
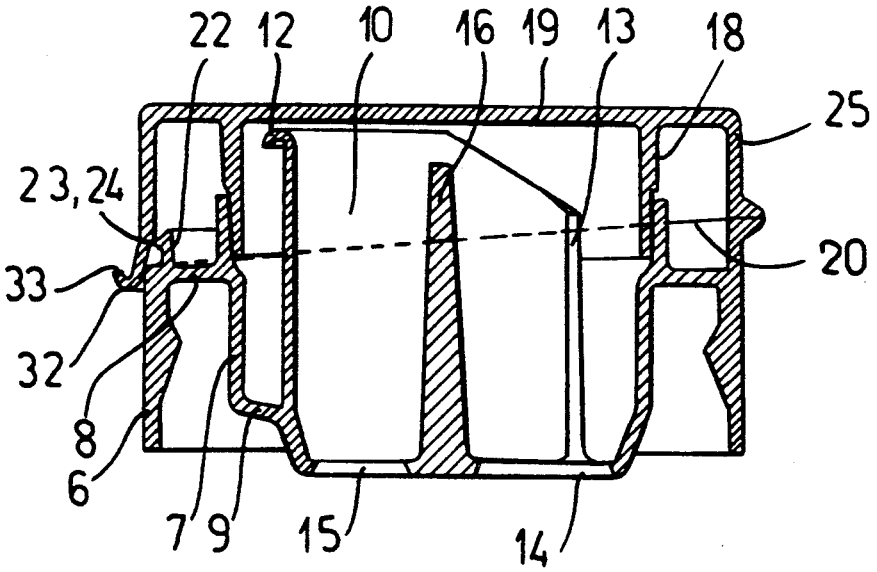

When the container equipped with this cap is closed the presence of the element 26 allows one to see instantly that there has been no tampering with the container. In order to open the container the user need merely pull on the tongue 34 to tear off the tamper-indicating element 26. The cover is then left in the position shown in FIGS. 6 and 7.

The user can then pull up on the hook 33 to tip the cover 3 into the open position. After use of the container the cover 3 can be returned simply and rapidly to its closed position in part due to the force exerted by the elastic return tongue 5.

As seen above the invention is a substantial improvement to the current state of the art in supplying a pouring cap of simple design that is particularly well adapted for use with bottles of oil because it provides for an excellent outflow of the product without risk of dirtying the outside of the container while ensuring an excellent tamperproofing of same prior to first use.

It goes without saying that the invention is not limited to the sole embodiment of the cap described above by way of example; instead it encompasses all variants.

Thus for example the internal structure of the cap can be simpler and can not have a central outflow tube without leaving the scope of the invention.

We claim:

1. A pouring cap for mounting atop a neck of a container, the cap being unitarily formed of a synthetic resin with:

a body adapted to fit over the neck of the container, itself forming a central outflow passage, and formed around the passage with an edge;

a cover sealingly engageable in a closed position with the body over the passage at the edge;

a hinge engaged at a location on the edge between the body and the cover;

a hook projecting from the cover in the closed position past the edge of the body at location on the edge opposite the hinge location;

an angularly extending retaining element on the body formed as an annular segment and defining an opening adjacent the edge opposite the hinge location, the hook being engageable with elastic deformation through the opening to catch underneath the retaining element and once inserted through the opening being engaged such that the hook or the element must be permanently deformed to over the cover from the closed position, whereby the hook and element retain the cover in the closed position until the element is stripped from the body; and frangible webs to each side of the opening releasably connecting the element to the body.

2. The pouring cap defined in claim 1 wherein the passage and edge are generally centered on an axis defined by a container on which the pouring cap is mounted, the hook projecting axially through the opening in the closed position of the cover, the hinge and hook locations being generally diametrically opposite.

3. The pouring cap defined in claim 2 wherein the element is a ring segment entered on a point offset from the axis.

4. The pouring cap defined in claim 2 wherein the element has a relatively thin lower part and a relatively thick upper part lying between the lower part and the cover, the two parts forming a surface level with the opening of the element and perpendicular to the axis.

5. The pouring cap defined in claim 4 wherein the cover and cap meet at a joint plane and the surface is level with the joint plane.

6. The pouring cap defined in claim 5 wherein the plane extends at an angle of about 95° to the axis.

7. The pouring cap defined in claim 5 wherein eh plane extends at a nonright angle to the axis.

8. The pouring cap defined in claim 7 wherein the hinge is axially offset from the hook and opening.

9. The pouring cap defined in claim 8 wherein the cap is further unitarily formed with:

a central tube defining the flow passage;

an inner rim surrounding the tube on the body; and an outer rim complementary to the inner rim, and on the cover, the rims interfitting sealingly in the closed position.

10. The pouring cap defined in claim 8 wherein the cap is further formed with inter engaging elastically releasable latching formations on the hook and on the edge of the body for releasably retaining the cover in the closed position.

11. A pouring cap for mounting atop a neck of a container, the cap being unitarily formed of a synthetic resin with :

a body adapted to fit over the neck of the container and having an outer body edge centered on an axis;

a central pour tube within the edge and forming an axially throughgoing outflow passage;

a cover sealingly engageable in a closed position with the body cover the passage at the edge;

a hinge engaged at a location on the edge between the body and the cover;

a hook formed as an annular segment projecting axially from the cover in the closed position past the edge of the body at a location on the edge generally diametrically opposite the hinge location, the edge being generally free of structure between the hinge and the hook;

an angularly extending retaining element formed as an annular segment and defining with the body an angularly limited opening adjacent the edge opposite the hinge location, the hook being engageable with elastic deformation through the opening to catch underneath the retaining element nd once inserted through the opening being engaged such that the hook or the element must be permanently deformed to move the cover from the closed position, whereby the hook and element retain the cover in the closed position until the element is tripped from the body; and frangible connecting yes flanking the opening and connecting the retaining element to the body.

* * * * *